US005222669A

United States Patent [19]

Lawson

[11] Patent Number: 5,222,669

[45] Date of Patent: Jun. 29, 1993

[54] RETAINING COVER AND SEALING ASSEMBLY FOR POP-UP SPRINKLERS

[75] Inventor: Kenneth L. Lawson, Rancho Cucamonga, Calif.

[73] Assignee: Anthony Manufacturing Corp., Industrial Products, Div., Azusa, Calif.

[21] Appl. No.: 840,401

[22] Filed: Feb. 24, 1992

[51] Int. Cl.[5] ..... B05B 15/06

[52] U.S. Cl. ..... 239/205; 239/203; 239/288.5; 285/81

[58] Field of Search ..... 239/201, 203, 204, 205, 239/206, 288.5; 285/45, 81, 321

[56] References Cited

U.S. PATENT DOCUMENTS

| | | | |
|---|---|---|---|
| 3,439,944 | 4/1969 | Leutenegger | 285/321 |
| 3,515,351 | 6/1970 | Costa | 239/206 |
| 3,591,205 | 7/1971 | Hamburg | 285/81 |
| 4,371,994 | 2/1983 | Mathews | 239/206 X |
| 4,564,221 | 1/1986 | Ishii | 285/321 X |
| 4,625,914 | 12/1986 | Sexton et al. . | |
| 4,834,289 | 5/1989 | Hunter | 239/205 |
| 4,867,379 | 9/1989 | Hunter . | |
| 4,892,252 | 1/1990 | Bruninga . | |
| 4,913,352 | 4/1990 | Witty et al. . | |
| 4,919,337 | 4/1990 | Van Leeuwen et al. . | |
| 4,925,098 | 5/1990 | DiPaola . | |
| 5,005,877 | 4/1991 | Hayman | 285/321 X |
| 5,058,806 | 10/1991 | Rupar | 239/205 |

FOREIGN PATENT DOCUMENTS

| | | | |
|---|---|---|---|
| 373920 | 6/1990 | European Pat. Off. | 285/321 |

*Primary Examiner*—Andres Kashnikow
*Assistant Examiner*—William Grant
*Attorney, Agent, or Firm*—Kelly, Bauersfeld & Lowry

[57] ABSTRACT

A pop-up irrigation sprinkler including a sprinkler case having an open upper end through which a sprinkler nozzle coupled to a sprinkler mechanism can be extended, the sprinkler mechanism being retained within the case by a retaining ring mounted in a groove in the case, and a retaining cover and sealing assembly for sealing the open end of the case around the nozzle and for preventing the split ring from being inadvertently unseated from the groove.

11 Claims, 2 Drawing Sheets

RETAINING COVER AND SEALING ASSEMBLY FOR POP-UP SPRINKLERS

BACKGROUND OF THE INVENTION

This invention relates to pop-up irrigation sprinklers, and more particularly, to a new and improved sprinkler retaining cover and sealing assembly for ensuring that a pop-up sprinkler mechanism can not become dislodged from within its protective case, and for effectively sealing the internal sprinkler mechanism against the entry of water, mud, sand, silt, dirt and the like when the sprinkler is not in operation.

Typically, pop-up sprinklers are used in situations when it is desirable to embed the sprinkler in the ground so that it does not project appreciably above ground level when not in use. In such pop-up sprinkler applications, the sprinkler mechanism is typically housed within a cylindrical upright case having an open upper end through which the pop-up portion of the sprinkler mechanism supporting a nozzle assembly can extend during irrigation periods. When not in use, the sprinkler mechanism is retracted within the case, and a cover, typically attached to the pop-up nozzle assembly, seats over the open upper end of the case to close the opening. Such arrangements have long been used with both rotary and non-rotary pop-up sprinklers, such as, for example, is disclosed in U.S. Pat. Nos. 4,625,914 issued Dec. 2, 1986 to Sexton et al.; U.S. Pat. No. 4,892,252 issued Jan. 9, 1990 to Bruninger; U.S. Pat. No. 4,919,337 issued Apr. 24, 1990 to Van Leewen et al. (each relating to rotary pop-up sprinklers); and U.S. Pat. No. 4,913,352 issued Apr. 3, 1990 to Witty et al. (relating to a non-rotary pop-up sprinkler).

In some such pop-up sprinklers, the pop-up sprinkler mechanism is secured within the sprinkler case by a releasable lock ring disposed below the cover and which seats within a groove formed around the inside of the case. Typically, the lock ring projects radially inwardly over a retaining ring such that to remove the sprinkler mechanism from the case, the lock ring must first be compressed and removed from its seated position within the groove, thereby to free the retaining ring for disassembly through the case opening. Exemplary of such pop-up sprinklers are those currently marketed by Hunter Industries under its model number G400, and by the Toro Company under its model numbers 660, 690 and 734.

One problem which has been encountered with the use of pop-up sprinklers employing lock rings to secure the sprinkler mechanism within the case is that of effectively sealing the lock ring and its mounting groove so that water, mud, sand, silt, dirt or other material can not seep inside the case during periods of non-use and clog the groove to prevent lock ring removal. Typically, over time as the surrounding turf or plants grow, the sprinkler becomes recessed relative to the surrounding soil, thereby allowing pools of water and mud to accumulate over the top of the sprinkler, such as may occur after an irrigation cycle has been completed, or as a result of rain or water run-off. Unless an effective seal is made between the sprinkler cover and the upper end of the case, such water, mud, dirt or other material may seep into the case resulting in the lock ring and groove becoming clogged or fouled, and, in areas when freezing conditions may be encountered, damage to the sprinkler mechanism within the case may occur as a result of expansion as the water turns to ice.

Another problem that has been encountered is that the lock ring may become unseated from its mounting groove as a result of vibrations caused by the repeated extensions and retractions of the pop-up sprinkler mechanism during use. Should the lock ring become unseated, the pop-up sprinkler mechanism will become dislodged from its mounting in the case, and hence, the sprinkler will cease to operate.

The present invention overcomes these problems by providing a sprinkler retaining cover and sealing assembly which insures that water, mud, sand, silt, dirt and other material can not enter the sprinkler case during periods of inoperation, and which prevents the lock ring securing the internal sprinkler mechanism within the case from inadvertently becoming loose or unseated, thereby ensuring that the sprinkler mechanism does not become dislodged during use.

SUMMARY OF THE INVENTION

In accordance with the present invention, the retaining cover and sealing assembly provides an effective and reliable seal to prevent water, mud, dirt and the like form seeping into the sprinkler case around the sprinkler nozzle housing during periods of sprinkler non-operation, and also provides a means for effectively and reliably holding the lock ring in its seated position to prevent inadvertent disassembly of the sprinkler mechanism, yet which still provides for convenient and easy access to the internal sprinkler without requiring that the case be removed from the ground or that the soil around the case be cleared or disturbed. Moreover, the retaining cover and sealing assembly of the present invention is relatively simple in design and inexpensive to manufacture, yet is highly reliable and effective in use.

More particularly, the retaining cover and sealing assembly of the present invention provides a case seal and ring protector for sealing the central opening of the sprinkler case against the entry of water, mud or other material into the case, and provides a means for positively holding the lock ring in its seated position so that the lock ring can not become loose or dislodged during sprinkler operations. Further, a retract seal is provided for sealing the retaining ring and nozzle housing during periods of non-operation of the sprinkler, thereby to reliably and effectively seal against the entry of water, mud or other material into the sprinkler case around the nozzle housing.

The many features and advantages of the present invention will become more apparent from the following detailed description taken in conjunction with the accompanying drawings which disclose, by way of example, the principles of the invention.

DETAILED DESCRIPTION OF PREFERRED EMBODIMENT

Figure 1:
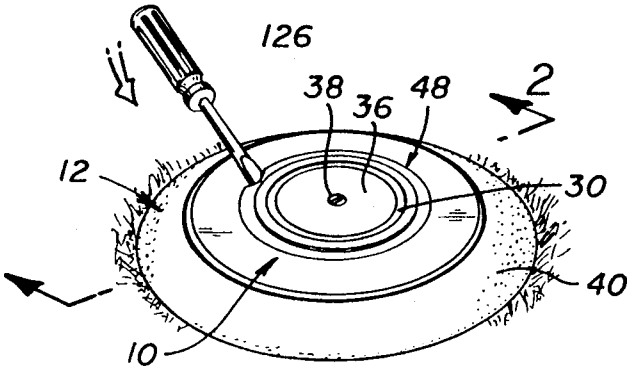
FIG. 1 is a perspective view showing a pop-up sprinkler having the retaining cover and sealing assembly of the present invention, and illustrating the use of a tool to remove the retaining cover of the invention for gaining access to the internal sprinkler mechanism.

As illustrated in the exemplary drawings, the present invention is embodied in a sprinkler retaining cover and sealing assembly, generally designated 10, for releasably securing a pop-up sprinkler mechanism within its protective case, and for sealing the internal sprinkler mechanism against the entrance of water, mud, sand, silt, dirt or other material into the case when the sprinkler is in the retracted, inoperative position within its case. In this instance, the sprinkler case, generally designated 12, has a relatively conventional, upright cylindrical shape formed typically from a lightweight molded plastic material or the like, and includes a generally cylindrical upper body portion 14 defining an upper end central opening 16, and a substantially closed bottom end portion (not shown) provided with inlet means for connecting the housing to a suitable water supply source (also not shown). The case 12 is adapted to be buried in the ground and forms a housing for containing and protecting a pop-up sprinkler mechanism of conventional design, herein generally designated 18.

The upper body portion 14 of the case 12 herein includes an enlarged diameter internal wall portion 20 dimensioned to permit the entire pop-up sprinkler mechanism 18 to be inserted into and removed from the case through the central opening 16 at its upper end. As illustrated herein, the sprinkler mechanism 18 is shown as a rotary pop-up sprinkler, the sprinkler mechanism typically including a water driven motor (not shown) coupled through a tubular pop-up riser 22 to a nozzle assembly 24 and which rotates the nozzle assembly relative to the sprinkler case 12. Also included within the sprinkler case 12 is a conventional retraction spring 26, the spring being coupled to the pop-up portion of the sprinkler mechanism 18 around the riser 22 at its lower end (not shown), and to the case at its upper end so that the spring is compressed when the nozzle assembly 24 is extended upwardly from the case during sprinkler operation, and then acts to retract the nozzle assembly back into the case to the inoperative position when an irrigation cycle has been completed. One such typical sprinkler mechanism is that such as disclosed in U.S. Pat. No. 4,625,914 issued Dec. 2, 1986 to Sexton et al, although as will become more apparent hereinafter, the present invention is also applicable with other types of non-rotary as well as rotary pop-up sprinkler mechanisms including turbine, gear, and impact driven rotary sprinklers.

As shown herein, the nozzle assembly 24 is coupled to the upper end of the riser 22 and includes a nozzle housing 28 of generally cylindrical shape having an upper end portion formed with a radially outwardly projecting annular lip or flange 30 which is adapted to overlie a portion of the effective upper end opening of the case 10 through which the pop-up riser 22 projects when the sprinkler is in operation. Within the nozzle housing 28 are mounted a range nozzle 32 and a spreader nozzle 34, the range nozzle being provided for projecting a stream of irrigating water outwardly from the sprinkler a greater distance than that projected by the spreader nozzle, as is well known to those familiar with the irrigation sprinkler art. In this instance, the upper end of the nozzle housing 28 herein includes a separate disc shaped cover 36 secured to the nozzle housing by a screw 38 which also functions to hold the range nozzle 32 within the nozzle housing. In this connection, it should be noted that the precise form of the nozzle housing 28 is not important to the present invention except to the extent that the upper end above the nozzle include some form of cap or cover having a radial lip or flange such as annular flange 30 which is adapted to extend beyond and overlie at least a portion of the effective upper end opening through the case 12, the reasons for which will become more apparent hereinafter.

In the inoperative position, the nozzle assembly 24 is retracted within the sprinkler case 12 so that the upper end of the nozzle housing 28 is substantially flush with the upper end of the case. In this instance, the case 12 includes a peripheral flange 40 which extends laterally outwardly from the top of the upper body portion 14 to provide a ground support surface for the case when the case is initially installed and embedded in the ground.

Figure 2:
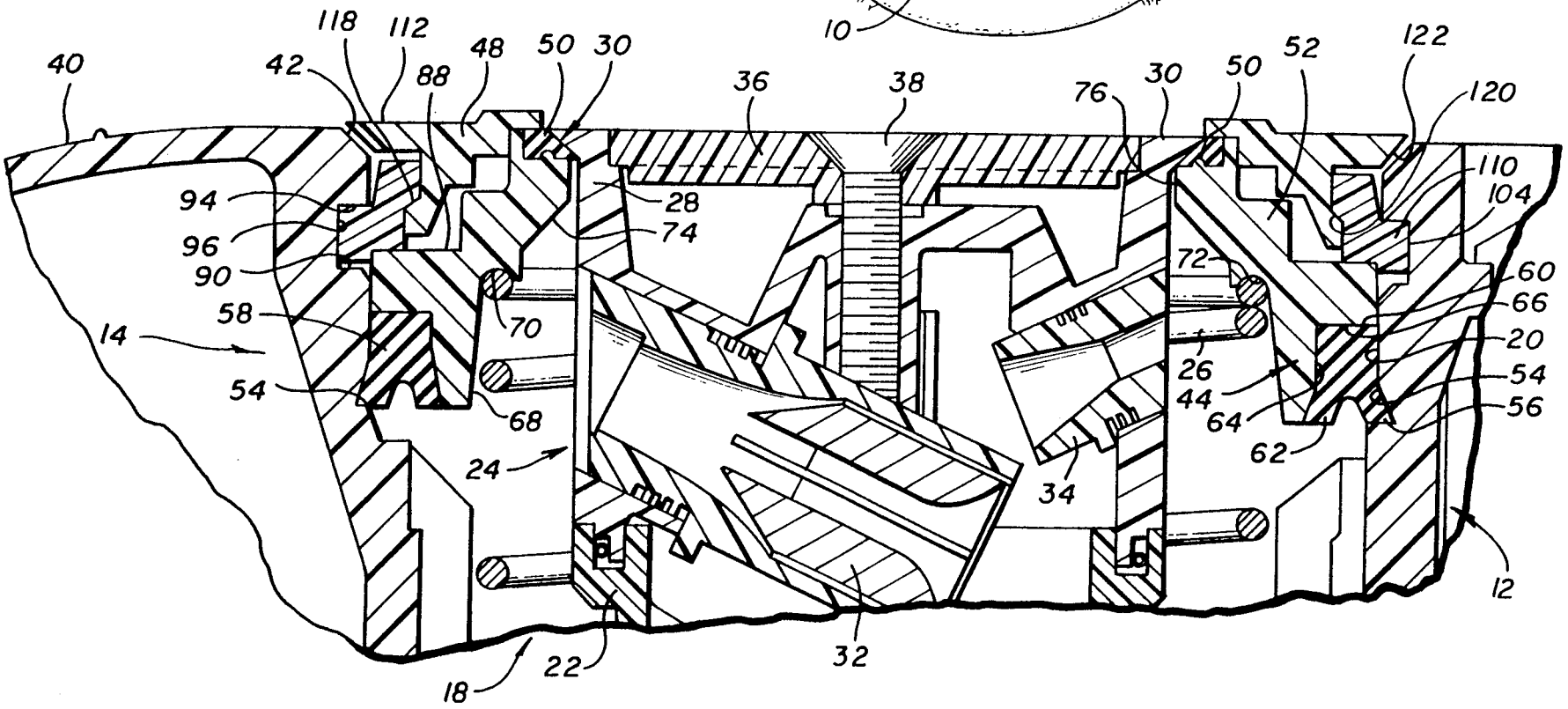
FIG. 2 is an enlarged fragmentary sectional view of the pop-up sprinkler of FIG. 1 taken substantially along line 2—2, and showing the retaining cover and sealing assembly of the invention.
Figure 3:
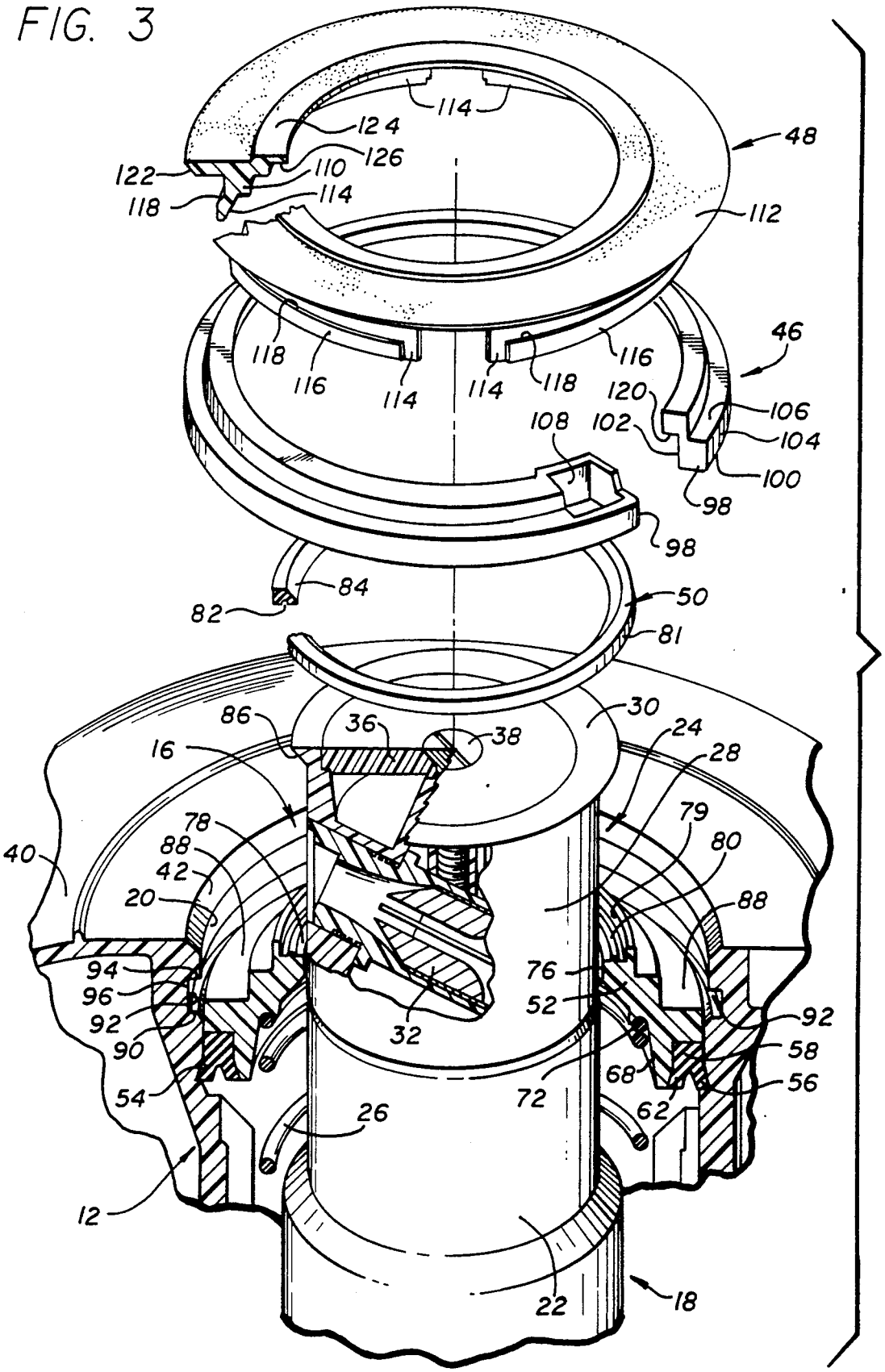
FIG. 3 is an exploded perspective view, partly in cross-section, showing further the components of the sprinkler of FIG. 2.

As best seen in FIG. 2, to retain the sprinkler mechanism 18 within the case 12, a cylindrical retaining ring 44 forming a seat for the upper end of the retraction spring 26 cooperates with a cylindrical lock ring 46 to hold the pop-up sprinkler mechanism in position inside the case. In this instance, the retaining ring 44, which may be conveniently formed of molded plastic, comprises a body 52 having a substantially circular horizontal cross-section, and is dimensioned to fit within the internal wall portion 20 of the case 12. In this respect, the internal wall portion 20 of the case 12 is formed with an interior annular recess 54 adapted to receive one leg 56 of an inverted, generally U-shaped packing seal 58 of conventional design, typically formed of rubber, the other leg 62 and top 60 of which are compressed against the sidewall 64 and top wall 66 of an outer annular recess formed around the body 52 of the retaining ring 44. This packing seal 58 acts to prevent water from leaking from the interior of the case 12 past the outer portion of the retaining ring 44, and also functions to position the retaining ring inside the upper body portion 14 of the case.

Disposed radially inwardly of the sidewall 64 forming the outer recess in the retaining ring body 52 is a cylindrical inner wall 68 extending upwardly from the lower end of the body to an inwardly directed radial shoulder 70 having a downwardly opening arcuate recess 72 dimensioned to receive and support the upper end of the retraction spring 26, thereby holding the sprinkler pop-up mechanism 18 within the case 12. Above the radial shoulder 70 of the retaining ring body 52 is a radially inwardly and upwardly inclined inner wall portion 74 terminating in a cylindrical wall portion 76 whose radial dimension is preferably slightly larger than the outer radial dimension of the nozzle housing 28 below the annular flange 30. This cylindrical wall portion 76 acts as a support and guide for the nozzle housing 28 and the pop-up riser 22 during operation and extension and retraction of the sprinkler mechanism 18 relative to the case 12.

The radially outer surface of the retaining ring body 52 also includes a generally horizontally extending and upwardly facing radial shoulder 88 disposed above the recess within which the packing seal 58 is compressed, and is positioned to be generally horizontally aligned with the lower radial wall 90 of a circumferential groove 92 formed in the internal wall portion 20 of the case 12, the remainder of the groove being defined by an upper radial wall 94 interconnected with the lower radial wall by a generally vertical wall 96, and whose dimensions are such as to receive an outer portion of the lock ring 46. The upwardly facing radial shoulder 88 of the retaining ring 44 and the circumferential groove 92 in the case 12 cooperate with the lock ring 46 to securely yet releasably retain the sprinkler mechanism 18 within the case and prevent the sprinkler mechanism from being removed from the case.

The lock ring 46, which also preferably is formed from a molded plastic material such as acetal plastic, is formed as a split ring having a relaxed outside diameter substantially equal to the diameter of the vertical wall 96 of the groove 92 in th case 12, and has oppositely directed ring ends 98 defining a gap therebetween which is of sufficient width to permit the ring to be compressed for insertion or removal through the upper end central opening 16 of the case 12 and into the groove. The lock ring 46 is formed to have a lower generally horizontal face 100 extending between an inner sidewall 102 and an outer sidewall 104 and which is dimensioned to extend from within the groove 92 radially inwardly over a portion of the upwardly facing radial shoulder 88 of the retaining ring 44. Projecting radially inwardly from the upper end of the outer side wall 104 is an upwardly facing shoulder 106 which is adapted to engage the upper radial wall 94 of the groove 92. By properly dimensioning the sidewall 104 of the lock ring 46 so that it can seat securely within the groove 92 when the lock ring is assembled, the lock ring will releasably hold the retaining ring 44 in position within the case 12. Should it become necessary to remove the sprinkler mechanism 18, the lock ring 46 can be radially compressed by squeezing the ends 98 together, a suitable recessed opening 108 being herein conveniently provided for this purpose adjacent one end of the split ring, thereby to free the lock ring from the groove 92. Once the lock ring 46 has been released and removed from the case 12, the retaining ring 44 can be lifted from the case, thereby permitting the sprinkler mechanism 18 to be also lifted from the case through the central opening 16.

When the case 12 has been installed, after a period of time the upper end of the case typically will become recessed below the level of the surrounding turf or soil, thereby exposing the upper end to water, mud, dirt and other material that may accumulate around the sprinkler unit over time. For example, as the surrounding turf or plants mature, water may begin to accumulate around the sprinkler unit and cause water and mud to pool on top of the nozzle housing 28 between irrigation cycles, or rain or water run-off can result in the pooling of water, dirt, mud and the like over the nozzle housing. In such cases, unless an effective water tight seal is provided between the nozzle housing 28 and the sprinkler case 12, such water, dirt, mud or other material can seep into the sprinkler case around the nozzle housing, thereby exposing the lock ring 46 and its mounting groove 92 to the build up of mud and dirt which can clog the ring and groove and hinder or prevent its removal. Further, absent an effective seal, the internal sprinkler mechanism 18 may be subjected to clogging or fouling, and, in areas where freezing conditions are encountered, possible damage due to the inherent nature of water to expand when it freezes.

In accordance with the present invention, the sprinkler retaining cover and sealing assembly 10 are provided to effectively and reliably seal between the nozzle housing 28 and the sprinkler case 12 to prevent any water, mud, sand, silt, dirt or other material from seeping into the case around the nozzle housing during periods of sprinkler inoperation, and which permits easy and convenient access to the internal sprinkler mechanism 18 without requiring that the case be removed or that the soil surrounding the pop-up sprinkler be disturbed or cleared. Moreover, the present invention provides a sprinkler retaining cover and sealing assembly 10 which is relatively simple in design and economical to manufacture, yet which is highly reliable and effective in use, to insure that the pop-up sprinkler mechanism 18 can not become loose or inadvertently dislodged from its mounting within the case 12.

Toward the foregoing ends, to insure that the lock ring 46 does not become loose or dislodged during sprinkler use, and to provide a covering seal between the case 12 and the assembled lock ring and retaining ring 44, the retaining cover and sealing assembly 10 includes a case seal and ring protector 48 releasably secured to the lock ring. In this instance, the protector 48, which preferably is formed from a molded thermoplastic elastomer material TPE.) such as Sanoprene made by Monsanto, comprises a ring shaped body 110 having an enlarged upper peripheral flange portion 112 dimensioned to extend over a portion of the upper end of the case 12, and an inner downwardly and radially outwardly directed cylindrical skirt portion 114, the skirt portion herein being segmented into four arcuate sections.

Disposed to project radially outwardly adjacent the lower end of each of the skirt portion segments 114 is a circumferential rib 116 forming an upwardly facing edge 118 which is adapted to seat under a downwardly facing shoulder 120 formed by a radially inwardly extending wall in the inner upper portion of the lock ring 46. Cooperation between the upwardly facing edges 118 of the ribs 116 and the downwardly facing shoulder 120 of the lock ring 46 will secure the protector 48 to the lock ring and prevent the lock ring from inadvertently becoming loose or otherwise being compressed and unseated from the groove 92.

To effectively and reliably seal the case seal and ring protector 48 to the case 12, the outer peripheral wall of the protector flange portion 112 is formed with a downwardly and radially inwardly extending inclined flat face 122 formed to tightly engage a corresponding downwardly and radially inwardly extending inclined edge wall 42 formed in the upper body portion 14 of the case 12. To insure a water tight seal between the protector 48 and the case 12, the height of the ribs 116 are dimensioned such that when the case seal and ring protector is assembled to the lock ring 46, the edges 118 will seat under the shoulder 120 of the lock ring and pull the inclined face 122 into tight frictional engagement with the corresponding inclined edge wall 42 of the case. Due to the compliant nature of the material of the case seal and ring protector 48, a water tight seal between the protector and the case 12 can thus be made.

In order to seal around the nozzle housing 28 to prevent water, mud and the like from entering the case 12 during periods of sprinkler inoperation, the retaining cover and seal assembly 10 includes a retract seal 50 herein mounted to the retaining ring 44 and held in place by the case seal and ring protector 48. To mount the retract seal 50, the upper end of the retaining ring body 52 includes an upwardly facing shoulder 78 formed to extend radially outwardly from the upper end of the cylindrical wall portion 76, and together with vertical sidewall 79 in the body and vertical sidewall 81 on th seal, locates the seal at the radially inner upper periphery of the retainer ring 44. A centrally disposed upwardly projecting bead 80 herein is formed on the shoulder 78 and receivers a cooperatively formed recessed groove 82 in the lower surface of the retract seal 50 to hold the retract seal in position.

The radially inner wall 84 of the retract seal 50 is inclined upwardly and outwardly to provide face-to-face water tight engagement with a corresponding inclined face 86 formed to extend downwardly and radially inwardly from the outer side of the annular flange 30 formed above the cylindrical sidewall of the nozzle housing 28.

To prevent the retract seal 50 from becoming unseated from its mounting on the retaining ring 44, the cap seal and ring protector 48 is provided with an inwardly directed annular flange portions 124 opposite the peripheral flange portion 112, and which defines a downwardly facing shoulder 126 disposed to overlie the upper surface of the retract seal 50 radially outwardly of the inclined inner wall 84. With this construction, when the sprinkler mechanism 18 is in the inoperative retracted condition, the nozzle housing 28 is sealed by the retract seal 50 to the retaining ring body 52, thereby effectively preventing water, mud, sand, silt, dirt or other material from entering into the case 12.

From the foregoing, it can be appreciated that the retaining cover and sealing assembly 10 of the present invention effectively and reliably seals the sprinkler case 12, against the entry of water, mud, sand and other material when the sprinkler is not in operation. Further, through use of the case seal and ring protector 48, the retaining cover and sealing assembly 10 insures that the lock ring 46 can not become inadvertently unseated from its mounting groove 92 during sprinkler operations, yet permits quick and easy access to the pop-up sprinkler mechanism 18 for service, repair or the like.

In this latter connection, as shown in FIG. 1, to gain access to the pop-up sprinkler mechanism 18, the case seal and ring protector 48 can be readily removed simply by prying the protector from its mounting on the lock ring 46 through use of a suitable tool, such as the illustrated screw driver 126. Since the case seal and ring protector 48 is made of a compliant material, as the case seal and ring protector 48 is pried upwardly, the skirt segments 114 will flex inwardly, thereby releasing the ribs 116 from their seated position under the shoulder 120 of the lock ring 46. Once the case seal and ring protector 48 has been removed, the lock ring 46 will be readily accessible for disassembly.

While a particular form of the present invention has been illustrated and described, it will be apparent that various changes and modifications can be made without departing from the principles of the present invention as set forth in the following claims.

I claim:

1. In a pop-up irrigation sprinkler of the type including in combination, a sprinkler case adapted to be buried in the ground and having an open upper end; a pop-up sprinkler mechanism mounted within the case, the sprinkler mechanism including a nozzle and overlying nozzle cover coupled to a riser and adapted to extend above the open end of the case when in operation and to be retracted within the case when not in operation; retaining ring means removably mounted within the case for retaining the sprinkler mechanism within the case; and lock ring means comprising a removable split ring seated within a circumferential groove in the case and engaging the retaining ring means to hold the retaining ring means in position within the case, the improvement comprising:

a retaining cover and sealing assembly overlying said retaining ring means and said lock ring means, said retaining cover and sealing assembly including means for sealing said open upper end of said case around said nozzle cover and retaining means for engaging and releasably retaining said split ring in said seated position within said case.

2. The improvement as set forth in claim 1 wherein said means for releasably retaining said split ring comprises a generally cylindrical case seal and ring protector releasably coupled to said split ring and preventing said split ring from being removed from said circumferential groove of said case.

3. The improvement as set forth in claim 2 wherein said case seal and ring protector includes means for engaging said case to seal said open upper end of said case to said case seal and ring protector.

4. The improvement as set forth in claim 3 wherein said retaining cover and sealing assembly further includes a retract seal coupled to said retaining ring means and held in place by said case seal and ring protector, said retract seal including means for sealing said case seal and ring protector to said nozzle cover.

5. The improvement as set forth in claim 4 wherein said means for engaging said case to seal said open upper end comprises an inclined radially inwardly and downwardly directed peripheral edge formed around the upper end of said cylindrical case seal and ring protector.

6. The improvement as set forth in claim 5 wherein said retract seal includes a radially inwardly and downwardly directed inner surface adapted to be sealingly engaged by said nozzle cover when said sprinkler is in an inoperative position retracted within said case.

7. The improvement as set forth in claim 2 wherein said case seal and ring protector is made from molded thermoplastic elastomeric material.

8. The improvement as set forth in claim 3 wherein said case seal and ring protector is made from molded a thermoplastic elastomeric material.

9. The improvement as set forth in claim 8 wherein said means for engaging said case to seal said open upper end comprises an inclined radially inwardly and downwardly directed peripheral edge formed around the upper end of said cylindrical case seal and ring protector.

10. The improvement as set forth in claim 9 wherein said retaining ring cover and sealing assembly further includes a retract seal coupled to said retaining ring means and held in place by said case seal and ring protector, said retract seal including means for sealing said case seal and ring protector to said nozzle cover.

11. The improvement as set forth in claim 10 wherein said retract seal includes a radially inwardly and downwardly directed inner surface adapted to be sealingly engaged by said nozzle cover when said sprinkler is in an inoperative position retracted within said case.

* * * * *